United States Patent [19]

Muto et al.

[11] Patent Number: 4,964,778

[45] Date of Patent: Oct. 23, 1990

[54] FORKLIFT TRUCK HAVING A TELESCOPIC AUXILIARY BOOM ARTICULATED TO A TELESCOPIC MAIN BOOM

[75] Inventors: James A. Muto; Ramesh P. Patel, both of Hagerstown, Md.

[73] Assignee: Kidde Industries, Inc., Iselin, N.J.

[21] Appl. No.: 385,445

[22] Filed: Jul. 27, 1989

[51] Int. Cl.[5] ..... B66F 9/06

[52] U.S. Cl. ..... 414/700; 414/708; 414/718; 414/728

[58] Field of Search ..... 414/718, 694, 700, 708, 414/728

[56] References Cited

U.S. PATENT DOCUMENTS

| | | | |
|---|---|---|---|
| 4,382,743 | 5/1983 | Newell | 414/718 X |
| 4,553,899 | 11/1985 | Magni | 414/718 X |
| 4,632,630 | 12/1986 | Maki et al. | 414/718 X |
| 4,775,288 | 10/1988 | Dimitriu | 414/718 X |

*Primary Examiner*—Robert J. Spar
*Assistant Examiner*—Donald W. Underwood
*Attorney, Agent, or Firm*—Brady, O'Boyle & Gates

[57] ABSTRACT

A forklift truck having a fork assembly connected to a telescopic auxiliary boom articulated to a telescopic main boom. The telescopic and articulating features of the auxiliary boom in conjunction with the telescopic feature of the main boom increases the range and reach of the fork assembly to above ground heights and to below ground depths.

14 Claims, 5 Drawing Sheets

FORKLIFT TRUCK HAVING A TELESCOPIC AUXILIARY BOOM ARTICULATED TO A TELESCOPIC MAIN BOOM

BACKGROUND OF THE INVENTION

To increase the operating range of material handling vehicles, such as forklift trucks, it has been proposed to connect the fork assembly to the end of a telescopic boom pivotally mounted on the truck. Such arrangements are disclosed, for example, in U.S. Pat. Nos. 4,147,263 and 4,674,944.

To increase the reach of the fork assembly; that is, the transfer of the load in a horizontal direction relative to the truck, the telescopic boom disclosed in U.S. Pat. No. 4,147,263 is mounted on a carriage which is slidably mounted on the truck chassis.

While these prior art forklift trucks have been satisfactory for their intended purpose, their construction and arrangement inherently limited the range and reach of the load handlers, not only for lifting loads to substantial heights, but also to below ground levels, and for reaching over obstacles encountered on the job site.

After considerable research and experimentation, the forklift truck of the present invention has been devised which increases the range and reach of the fork assembly beyond that obtainable by the prior art trucks.

SUMMARY OF THE INVENTION

The forklift truck of the present invention comprises, essentially, a truck having a two-section main boom pivotally mounted on the truck frame, a two-section auxiliary boom pivotally mounted to the fly section of the main boom, and a fork assembly pivotally connected to the fly section of the auxiliary boom. A luffing cylinder is positioned beneath the main boom and is connected between the truck frame and base section of the main boom, and a second luffing cylinder is positioned beneath the auxiliary boom and connected between the nose of the main boom fly section, and the base section of the auxiliary boom.

The forklift truck is dimensioned, and the relative positions of the pivotal connection of the main boom to the truck frame and the pivotal connection of the auxiliary boom to the main boom are such that in the contracted position, the main boom is substantially horizontal and the auxiliary boom depends from the end of the main boom in a slightly inclined position in a vertical plane, in proximity to the front wheels of the truck. In this position the articulated auxiliary boom allows the load to be carried close to the front wheels, thereby enhancing the stability and driveability of the truck in the travel mode.

In order that the forklift truck of the present invention may have access through door openings having eight foot heights, the auxiliary boom luffing cylinder is extended to lift the auxiliary boom away from the front wheels, and the main boom luffing cylinder is retracted to lower the main boom from the substantially horizontal position to a position parallel to the ground below the eight foot height of the door opening.

The versatility of the machine is enhanced to operate in various narrow, as well as, lower working environments, whereby the operator can achieve the shortest overall vehicle length or lowest overall machine height by merely articulating the auxiliary boom forward or back in conjunction with raising or lowering the main boom.

The articulated two-section auxiliary boom increases the range of the fork assembly between below ground operation and vertical height operation, as well as horizontal reach and working over obstacles at the job site.

DESCRIPTION OF THE PREFERRED EMBODIMENT

Figure 1:
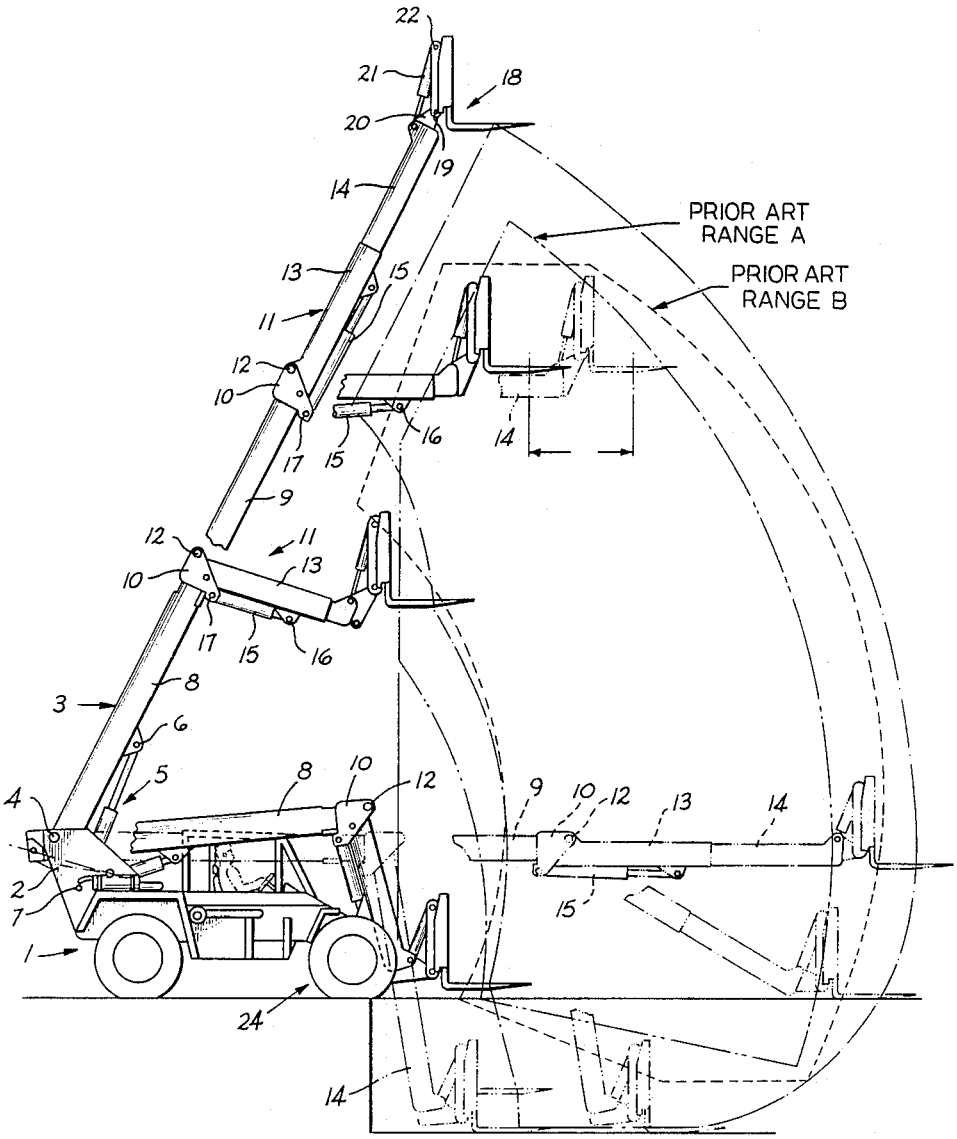
FIG. 1 is a diagrammatic, side elevational view of the forklift truck of the present invention illustrating the range and reach of the forklift truck of the present invention in comparison to that of prior art forklift trucks, wherein the fork assembly is connected to the end of a telescopic boom.

Referring to the drawings, and more particularly to FIG. 1, the forklift truck of the present invention comprises a conventional low profile self-propelled vehicle 1 including a frame 2 to which a main boom 3 is pivotally connected thereto as at 4. A lift or luffing cylinder 5 is positioned below the main boom and is pivotally connected thereto as at 6, and to the vehicle frame 2 as at 7. The main boom 3 is a two-section boom consisting of the base section 8 to which the lift cylinder 5 is connected, and fly section 9 having a nose portion 10 to which an auxiliary boom 11 is pivotally connected thereto as at 12.

The auxiliary boom 11 is also a two-section boom consisting of a base section 13 and a fly section 14. A lift cylinder 15 is positioned beneath the base section 13 of the auxiliary boom and pivotally connected thereto as at 16 and to the nose portion 10 of the main boom as at 17.

A fork assembly 18 is pivotally connected as at 19 to the moveable substantially triangular shaped nose portion 20 which is pivoted at 23 to the forward end of fly section 14 of the auxiliary boom. The fork assembly is maintained in a general horizontal position throughout the range of movement of the main or auxiliary booms by a slave cylinder 21 pivotally connected between the fork assembly as at 22, and end of the fly section 14 as at 23, along the same pivot connection thereto as the moveable nose portion 20.

By the articulation of the two-section auxiliary boom 11 to the two-section main boom 3, the range and reach of the forklift truck of the present invention is significantly increased over that provided by the prior art.

Range A, illustrated by the long and short dash lines, represents the range and reach obtainable by the prior art forklift trucks, wherein the fork assembly is connected to the end of a multi-section boom pivotally connected to the truck frame. Range B, illustrated by the short dash lines, represents the range and reach obtainable by the prior art forklift trucks of the type disclosed in the aforementioned U.S. Pat. No. 4,147,263. The range and reach, illustrated by the solid line, is obtained by the forklift truck of the present invention.

Figure 2:
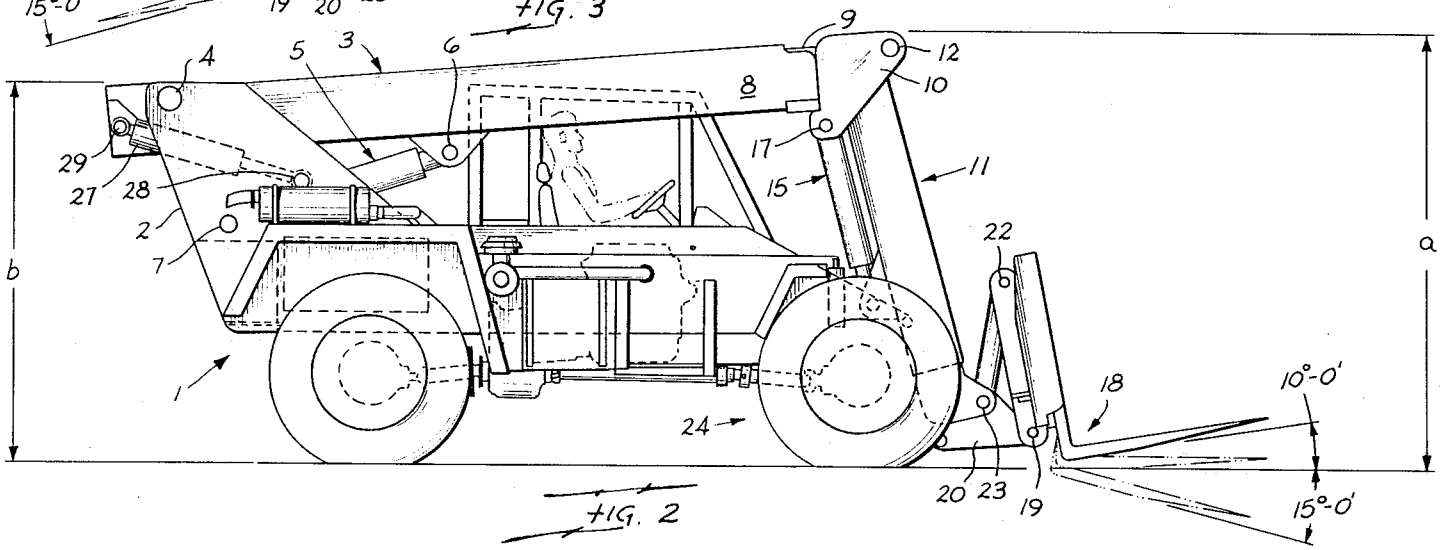
FIG. 2 is a side elevational view of the forklift truck of the present invention, wherein the auxiliary boom is in the fully retracted position in proximity to the front wheels of the truck.
Figure 4:
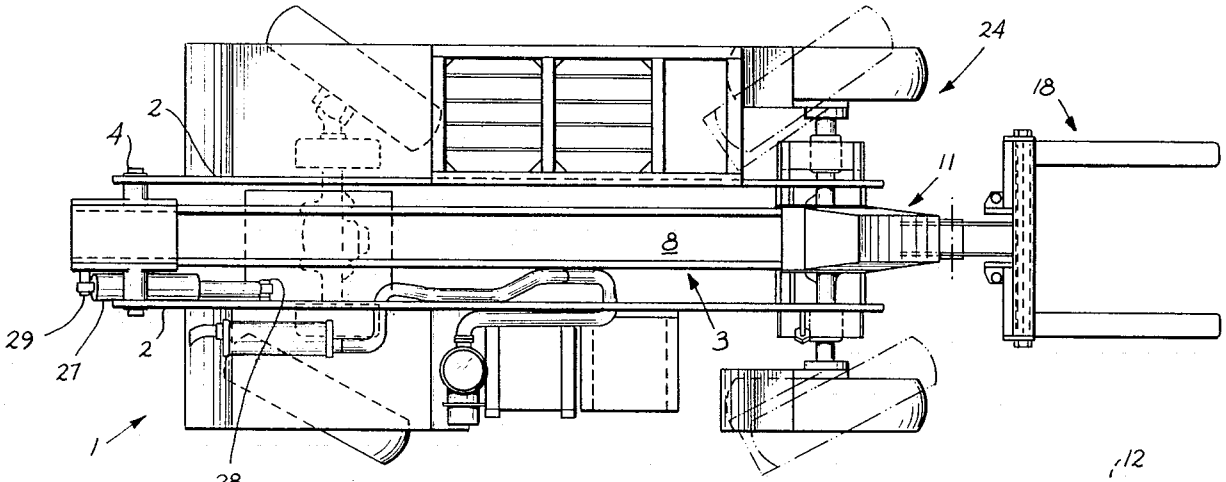
FIG. 4 is a top plan view of the forklift truck of the present invention.
Figure 5:
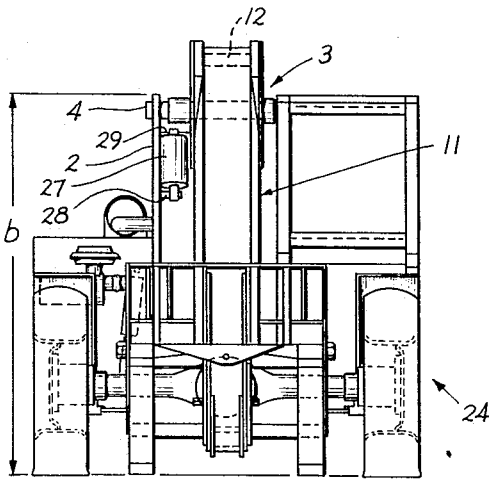
FIG. 5 is a front elevational view of the truck as shown in FIG. 2.

Referring to FIG. 2, the forklift truck is dimensioned and the relative positions of the pivotal connection 4 of the main boom 3 to the truck frame 2, and the pivotal connection 12 of the auxiliary boom 11 to the main boom 3 are such in the contracted position, that the main boom 3 is substantially horizontal and the auxiliary boom 11 depends from the end of the main boom in a slightly inclined position in a vertical plane in proximity to the front wheels 24 of the truck. In this position the articulated auxiliary boom allows a load on the fork assembly 18 to be carried close to the front wheels 24, thereby enhancing the stability and driveability of the truck in the travel mode.

The relative positions of the main boom 3 and articulated auxiliary boom 11 as shown in FIG. 2, provide the shortest overall working length with a height of approximately 107.45" represented by the vertical dimension line "a" extending from the top edge of the boom nose portion 10 to the ground. The height of the top edge of the truck frame 2 from the ground measures approximately 94" as represented by dimension line "b".

Figure 3:
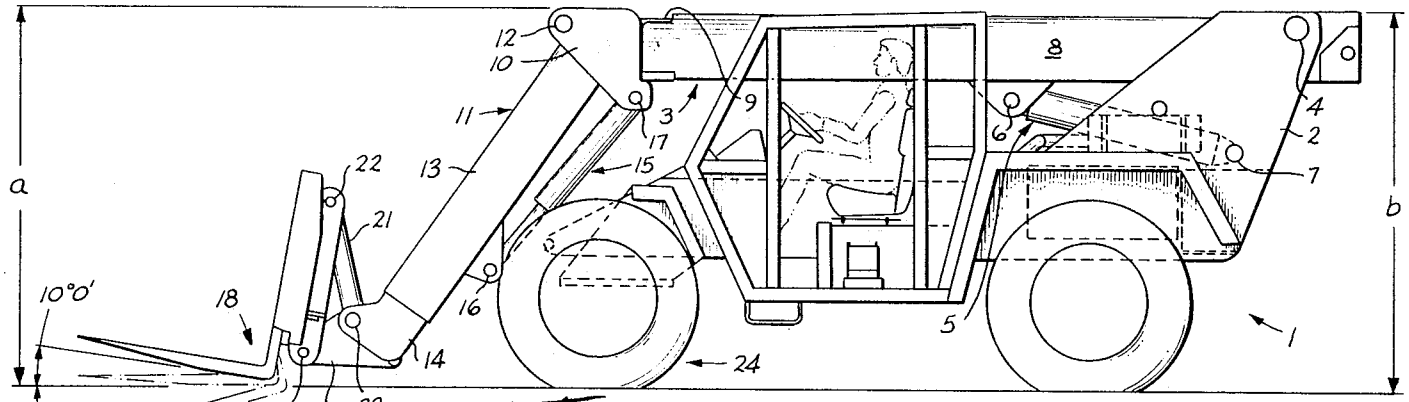
FIG. 3 is a side elevational view of the opposite side of the forklift truck of the present invention, wherein the auxiliary boom is moved to a position away from the truck front wheels and the main boom is lowered to a position parallel to the ground for shortening the overall height of the truck.

In order that the forklift truck may have access through door openings having eight foot heights, the relative positions of the main boom 3 and auxiliary boom 11 are changed as shown in FIG. 3, wherein the auxiliary boom luffing cylinder 15 is extended to lift the auxiliary boom away from the front wheels 24, and the main boom luffing cylinder 5 is retracted to lower the main boom 3 to a position parallel to the ground and aligned with the top edge of the frame In this position dimension "a" is equal to dimension "b", namely, 94".

Figure 6:
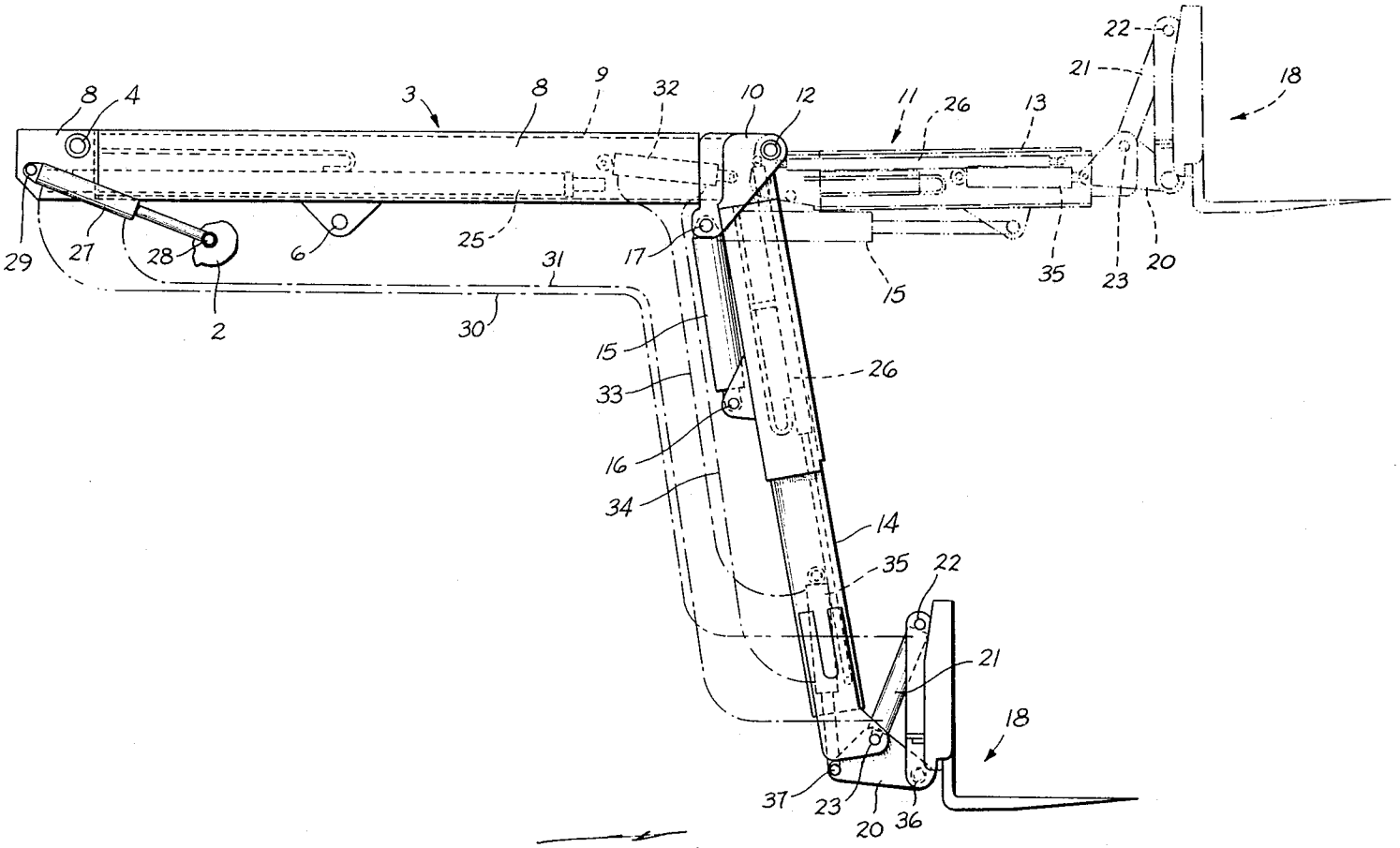
FIG. 6 is a side elevational view of the main boom and auxiliary boom illustrating the auxiliary boom in a retracted horizontal position, and in an extended, lowered position.

FIG. 6 illustrates the details of the construction of the main boom 3 and auxiliary boom 11 wherein it will be seen that a longitudinally extending hydraulic cylinder 25 is mounted within the main boom for extending and retracting the fly section 9, and a hydraulic cylinder 26 is similarly mounted within the auxiliary boom for extending and retracting its fly section 14.

In order to maintain the forklift assembly 18 level or horizontal during the manipulation of the main boom 3 and/or auxiliary boom 11, a master hydraulic cylinder 27 is connected between the truck frame 2 as at 28 and the end of the main boom base section 8 as at 29, the master cylinder 27 being in communication with the slave cylinder 21 through hydraulic lines 30, 31. Another master hydraulic cylinder 32 is mounted within the fly section of the main boom 3 and connected to the main section 13 of the auxiliary boom 11. The master cylinder 32 is in communication through hydraulic lines 33 and 34 with slave cylinder 35 mounted in the fly section 14 of the auxiliary boom. The slave cylinder 35 is pivotally connected at 37 to the moveable nose portion 20 that is pivoted to the fly section at 23, which in turn is pivotally connected to the fork assembly 18 as at 36. The telescoping cylinders 25, 26, master cylinder 32, slave 35 and associated hydraulic lines are enclosed within the respective main boom 3 and auxiliary boom 11 to thereby protect the components from damage while on the job site.

Figure 7:
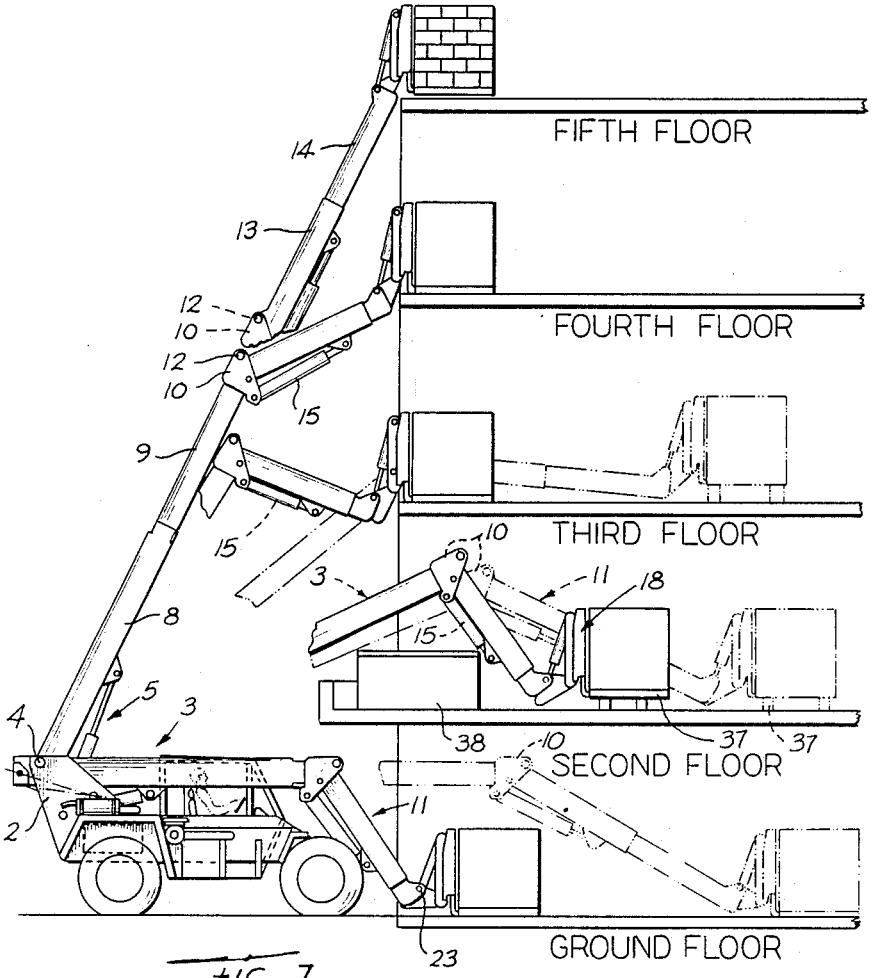
FIG. 7 is a diagrammatic side elevational view of the forklift truck of the present invention illustrating the range and reach of the fork assembly operating at a five story building.
Figure 8:
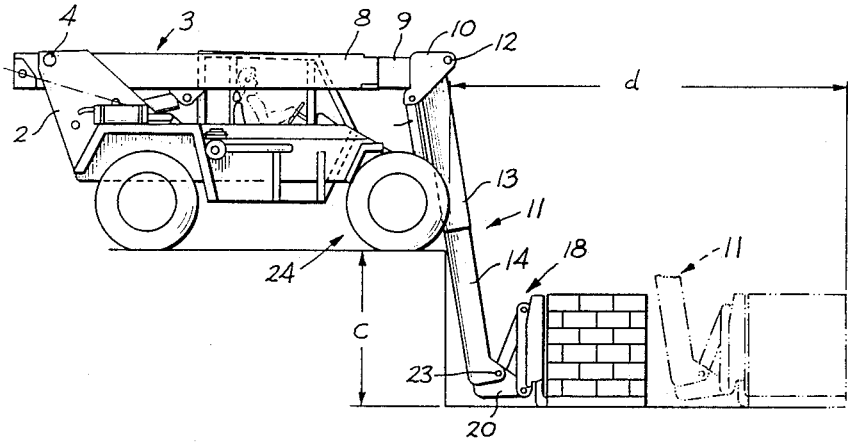
FIG. 8 is a diagrammatic, side elevational view of the forklift truck of the present invention illustrating the operation of the fork assembly at a below ground level.

The versatility of the forklift truck of the present invention is illustrated in FIGS. 7 and 8, wherein the fork assembly 18 is adapted to work at a fifth floor level by fully extending the fly sections 9 and 14. By positioning the pivotal connection 12 of the auxiliary boom to the main boom 3 above the top surface of the base section 13 of the auxiliary boom, the base boom 3, and auxiliary boom 11 are substantially aligned when moved to the fifth floor position as shown in FIG. 7, or the horizontal position as shown in FIG. 1.

By the hydraulic control of the telescopic and articulating features of the auxiliary boom 11 in conjunction with the hydraulic control of the maim boom 3 maximum horizontal reach at various floor levels can be achieved as shown in FIG. 7. The telescopic feature of the articulated auxiliary boom 11 allows, for example, 5'-0" of horizontal boom travel without moving the truck. Furthermore, as shown on the second floor, the main boom 3 and auxiliary boom 11 can be manipulated to handle working pallets 37 over obstacles 38. This is accomplished by positioning the auxiliary boom 11 in a horizontal mode and reaching over the obstacle 38 by extending either the main boom 3 on auxiliary boom 11 and then articulating the auxiliary boom 11 downwardly for loading or unloading the pallet 37.

FIG. 8 illustrates the versatility of the forklift truck of the present invention for working below ground level. The telescopic feature of the articulated auxiliary boom 11 allows the loading or unloading of a pallet to a below ground depth of 6'-2" represented by dimension line "c", with a horizontal reach, at that depth, of 16'-2" represented by dimension line "d". The ability to articulate and telescope the auxiliary boom 11 below ground at a close position to the truck front wheels 24 not only enhances the below ground reach of the auxiliary boom but also enhances the capability of the truck to carry a heavy load.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A forklift truck, comprising a truck frame, a telescopic main boom having one end pivotally connected to the truck frame, a telescopic auxiliary boom having one end pivotally connected to the opposite end of the main boom, and a fork assembly pivotally connected to the opposite end of the auxiliary boom, said main boom including a base section and a fly section slidably mounted therein, said auxiliary boom including a base section and a fly section slidably mounted therein, the base section of the main boom being pivotally connected to the truck frame, the base section of the auxiliary boom being pivotally connected to the fly section of the main boom at a position above the upper surface of the auxiliary boom base section, a lift cylinder connected between the truck frame and the base section of the main boom for luffing the main boom relative to the truck, a second lift cylinder connected between the fly section of the main boom and the base section of the auxiliary boom, whereby the auxiliary boom is articulated to the main boom and movable relative thereto between a position wherein the auxiliary boom is substantially aligned with the longitudinal axis of the main boom to a position wherein the auxiliary boom depends from the end of the main boom in an inclined position in a vertical plane in proximity to the front wheels of the truck, whereby a load can be carried on the fork assembly close to the truck front wheels, thereby enhancing the stability and driveability of the truck in the travel mode.

2. A forklift truck according to claim 1, wherein the forklift truck is dimensioned and the relative positions of the pivotal connection of the main boom to the truck frame and the pivotal connection of the auxiliary boom to the main boom are such that when in the contracted position the main boom is substantially horizontal and the auxiliary boom is in said dependent inclined position.

3. A forklift truck according to claim 2, wherein the forklift truck is movable through a door opening by lowering the main boom to a position parallel to the ground and lifting the auxiliary boom to a position away from the truck front wheels.

4. A forklift truck according to claim 1, wherein the first and second lift cylinders are positioned beneath their respective base sections.

5. A forklift truck according to claim 1, and said fork assembly pivotally connected to the outer end of the fly section of the auxiliary boom at a position above the upper surface of the auxiliary boom fly section.

6. A forklift truck, comprising a truck frame, a telescopic main boom having one end pivotally connected to the truck frame, a telescopic auxiliary boom having one end pivotally connected to the opposite end of the main boom, and a fork assembly pivotally connected to the opposite end of the auxiliary boom, said main boom including a base section and a fly section slidably mounted therein, said auxiliary boom including a base section and a fly section slidably mounted therein, the base section of the main boom being pivotally connected to the truck frame, the base section of the auxiliary boom being pivotally connected to the fly section of the main boom, a lift cylinder connected between the truck frame and the base section of the main boom for luffing the main boom relative to the truck, a second lift cylinder connected between the fly section of the main boom and the base section of the auxiliary boom, and a moveable nose portion pivotally connected to said fork assembly and pivotally connected to the outer end of said auxiliary boom fly section at a position above the upper surface of the auxiliary boom fly section, whereby the auxiliary boom is articulated to the main boom and movable relative thereto between a position wherein the auxiliary boom is substantially aligned with the longitudinal axis of the main boom to a position wherein the auxiliary boom depends from the end of the main boom in an inclined position in a vertical plane in proximity to the front wheels of the truck, whereby a load can be carried on the fork assembly close to the truck front wheels, thereby enhancing the stability and driveability of the truck in the travel mode.

7. A forklift truck according to claim 6, including first slave cylinder means connected between said fork assembly and said pivotal connection of said moveable nose portion to the outer end of the auxiliary boom fly section, first master cylinder means operatively connected to said first slave cylinder means, and said first master cylinder means pivotally connected between said main boom base section and said truck frame.

8. A forklift truck according to claim 7, including second slave cylinder means connected between the auxiliary boom fly section and said moveable nose portion, second master cylinder means operatively connected to said second slave cylinder means, said second master cylinder means pivotally connected between said main boom fly section and said auxiliary boom base section, whereby the fork assembly is maintained in a horizontal position during all articulated positions of the main boom and the auxiliary boom.

9. A forklift truck according to claim 1, in which the pivot connection of said main boom base section to the truck frame, and the pivot connection of said auxiliary boom base section to said fly section of the main boom are in substantial alignment in the same plane below and closely adjacent the plane of the upper surface of the main boom fly section.

10. A forklift truck according to claim 9, wherein the pivot connection of said auxiliary boom base section to said main boom fly section and said same plane containing said pivot connection are moveable downwardly by said lift cylinder between the truck frame and the main boom base section to a position parallel with the ground, whereby the forklift truck is moveable through a door opening.

11. A forklift truck according to claim 10, and wherein in said depending position of said auxiliary boom, said pivot connection of said fork assembly to the opposite end of said auxiliary boom, is moved further forwardly of the pivot connection of said auxiliary boom base section to said main boom when the latter pivot connection is moved downwardly for moving through a door opening.

12. A forklift truck according to claim 1, in which the pivot connection of said main boom base section to the truck frame, and the pivot connection of said auxiliary boom base section to said fly section of the main boom are in substantial alignment in the same plane above the plane of the upper surface of the auxiliary boom base section when said auxiliary boom is substantially aligned with the longitudinal axis of said main boom.

13. A forklift truck, comprising a truck frame, a telescopic main boom having one end pivotally connected to the truck frame, a telescopic auxiliary boom having one end pivotally connected to the opposite end of the main boom, and a fork assembly pivotally connected to the opposite end of the auxiliary boom, said main boom including a base section and a fly section slidably mounted therein, said auxiliary boom including a base section and a fly section slidably mounted therein, the base section of the main boom being pivotally connected to the truck frame, the base section of the auxiliary boom being pivotally connected to the fly section of the main boom, a lift cylinder connected between the truck frame and the base section of the main boom for luffing the main boom relative to the truck, a second lift cylinder connected between the fly section of the main boom and the base section of the auxiliary boom, and said fork assembly pivotally connected to the outer end of the fly section of the auxiliary boom at a position above the upper surface of the auxiliary boom fly section, whereby the auxiliary boom is articulated to the main boom and movable relative thereto between a position wherein the auxiliary boom is substantially aligned with the longitudinal axis of the main boom to a position wherein the auxiliary boom depends from the end of the main boom in an inclined position in a vertical plane in proximity to the front wheels of the truck, whereby a load can be carried on the fork assembly close to the truck front wheels, thereby enhancing the stability and driveability of the truck in the travel mode.

14. A forklift truck, comprising a truck frame, a telescopic main boom having one end pivotally connected to the truck frame, a telescopic auxiliary boom having one end pivotally connected to the opposite end of the main boom, and a fork assembly pivotally connected to the opposite end of the auxiliary boom, said main boom including a base section and a fly section slidably mounted therein, said auxiliary boom including a base section and a fly section slidably mounted therein, the base section of the main boom being pivotally connected to the truck frame, the base section of the auxiliary boom being pivotally connected to the fly section of the main boom, a lift cylinder connected between the truck frame and the base section of the main boom for luffing the main boom relative to the truck, a second lift cylinder connected between the fly section of the main boom and the base section of the auxiliary boom, and a moveable nose portion pivotally connected to said fork assembly and pivotally connected to the outer end of said auxiliary boom fly section, first slave cylinder means connected between said fork assembly and said pivotal connection of said moveable nose portion to the outer end of the auxiliary boom fly section, first master cylinder means operatively connected to said first slave cylinder means, and said first master cylinder means pivotally connected between said main boom base section and said truck frame, second slave cylinder means connected between the auxiliary boom fly section and said moveable nose portion, second master cylinder means operatively connected to said second slave cylinder means, said second master cylinder means pivotally connected between said main boom fly section and said auxiliary boom base section, whereby the auxiliary boom is articulated to the main boom and movable relative thereto between a position wherein the auxiliary boom is substantially aligned with the longitudinal axis of the main boom to a position wherein the auxiliary boom depends from the end of the main boom in an inclined position in a vertical plane in proximity to the front wheels of the truck, and the fork assembly is maintained in a horizontal position during all articulated positions of the main boom and the auxiliary boom, whereby a load can be carried on the fork assembly close to the truck front wheels, thereby enhancing the stability and driveability of the truck in the travel mode.

* * * * *